US009631853B2

(12) United States Patent
Lee

(10) Patent No.: US 9,631,853 B2
(45) Date of Patent: Apr. 25, 2017

(54) METHOD FOR CONTROLLING ICEMAKER FOR REFRIGERATOR

(75) Inventor: Jung Owan Lee, Incheon (KR)

(73) Assignee: DAEWOO ELECTRONICS CORPORATION, Seoul (KR)

( * ) Notice: Subject to any disclaimer, the term of this patent is extended or adjusted under 35 U.S.C. 154(b) by 1074 days.

(21) Appl. No.: 13/824,469

(22) PCT Filed: Sep. 20, 2011

(86) PCT No.: PCT/KR2011/006924

§ 371 (c)(1),
(2), (4) Date: Mar. 18, 2013

(87) PCT Pub. No.: WO2012/039569

PCT Pub. Date: Mar. 29, 2012

(65) Prior Publication Data

US 2013/0174587 A1 Jul. 11, 2013

(30) Foreign Application Priority Data

Sep. 20, 2010 (KR) ..... 10-2010-0092354
Sep. 20, 2010 (KR) ..... 10-2010-0092356
Sep. 20, 2010 (KR) ..... 10-2010-0092358

(51) Int. Cl.
*F25C 1/00* (2006.01)
*F25C 5/08* (2006.01)
*F25C 1/04* (2006.01)

(52) U.S. Cl.
CPC ..... *F25C 1/00* (2013.01); *F25C 1/04* (2013.01); *F25C 5/08* (2013.01); *F25C 2500/06* (2013.01);
(Continued)

(58) Field of Classification Search
CPC ..... F25C 5/005; F25C 5/08; F25C 2300/00; F25C 2305/00; F25C 2500/06;
(Continued)

(56) References Cited

U.S. PATENT DOCUMENTS 4,909,039 A * 3/1990 Yamada ..... F25C 1/04 340/622
5,182,916 A * 2/1993 Oike ..... F25C 1/04 62/135
(Continued)

FOREIGN PATENT DOCUMENTS

JP 1998-239168 9/1995
KR 10-2005-0016013 2/2005
(Continued)

OTHER PUBLICATIONS

KR 10-2009-0128906 (English translation).*
International Search Report for international application No. PCT/KR2011/006924, dated Jun. 1, 2012 (8 pages).

*Primary Examiner* — Jonathan Bradford

(57) ABSTRACT

The present invention relates to a method of controlling an icemaker for a refrigerator, and more particularly to a method of controlling an icemaker for a refrigerator which can automatically determine a water shortage situation during water supplying, ice making, and ice separating processes of the icemaker, can prevent production of imperfect ice pieces, and can solve an ice separating defect, thereby smoothly performing an operation of the icemaker.

11 Claims, 4 Drawing Sheets

(52) U.S. Cl.
CPC ..... *F25C 2600/02* (2013.01); *F25C 2600/04* (2013.01); *F25C 2700/04* (2013.01); *F25C 2700/12* (2013.01); *F25C 2700/14* (2013.01)

(58) Field of Classification Search
CPC ..... F25C 2500/08; F25C 2600/02; F25C 2600/04; F25C 2700/04; F25C 2700/12; F25C 2700/14
See application file for complete search history.

(56) References Cited

U.S. PATENT DOCUMENTS

| | | | | | |
|---|---|---|---|---|---|
| 5,778,686 | A * | 7/1998 | Choi | ..... | F25C 1/04 62/135 |
| 2006/0201170 | A1* | 9/2006 | Cole | ..... | F25C 1/04 62/135 |
| 2006/0266067 | A1* | 11/2006 | Anderson | ..... | F25C 1/04 62/340 |

FOREIGN PATENT DOCUMENTS

| | | |
|---|---|---|
| KR | 10-2005-0102993 | 10/2005 |
| KR | 10-2006-0090916 | 8/2006 |
| KR | 10-2007-0065740 | 6/2007 |
| KR | 10-2008-0108188 | 12/2008 |
| KR | 1010-2008-0108188 | 12/2008 |
| KR | 10-2009-012337 | 12/2009 |
| KR | 10-2009-0123337 | 12/2009 |
| KR | 10-2009-0128906 | 12/2009 |

* cited by examiner

METHOD FOR CONTROLLING ICEMAKER FOR REFRIGERATOR

TECHNICAL FIELD

The present invention relates to a method of controlling an icemaker for a refrigerator, and more particularly to a method of controlling an icemaker for a refrigerator by which water supplying, ice making, and ice separating processes of the icemaker can be smoothly performed.

BACKGROUND ART

In general, a refrigerator refers to an apparatus for cooling interiors of a refrigerating compartment and a freezing compartment and freshly maintaining foods for a predetermined of time as it repeats a refrigeration cycle in which a refrigerant is compressed, condensed, expanded, and evaporated.

To this end, a refrigerator includes a compressor for compressing a refrigerant, a condenser for condensing the refrigerant introduced from the compressor with exterior air, an expansion valve for reducing pressure of the refrigerant introduced from the condenser, and an evaporator for absorbing heat in the refrigerator as the refrigerant having passed through the expansion valve is evaporated in a low pressure state.

The refrigerator includes a body defining a receiving space divided into a refrigerating compartment and a freezing compartment therein, and doors for opening and closing the refrigerating chamber and the freezing chamber at a front side thereof, and a machine chamber is formed in the body such that the compressor and the condenser are installed therein.

Further, an icemaker for automatically sequentially supplying water, making ice pieces, and separating the ice pieces to manufacture ice pieces may be installed in the freezing compartment, and a predetermined manufactured ice pieces are preserved. Further, a dispenser for withdrawing ice pieces to the outside is mounted to the door.

The icemaker includes a water supply tank in which water for manufacturing ice pieces is stored, an ice tray to which the water stored in the water supply tank and in which ice pieces are manufactured, and an ice bank in which the ice pieces manufactured in the ice tray are stored.

The ice pieces completely manufactured in the ice tray are separated through heating of an ice separating heater.

However, the icemaker according to the related art wastes energy as an ice making mode is repeated even when a water shortage situation such as suspension of water supply, a local water pressure difference, and suspension of a water service is generated during a water supply process. That is, since the icemaker according to the related art fails to have a control algorithm for determining a water shortage condition (abnormal water supply), the mode of the ice maker cannot be converted into a preserving mode in the water shortage condition and the ice maker is still operated in an ice making mode.

Further, the icemaker according to the related art an ice separating process following a heating process regardless of a state of ice pieces once it reaches an ice making completing temperature. That is, imperfect ice pieces in which an outer side thereof is frozen but an interior thereof is still unfrozen may be produced, which ice pieces may be broken during an ice separating process, causing ice pieces preserved in an ice bank to be stuck to each other. That is, as the icemaker according to the related art determines completion of ice making only through measurement of temperature by a sensor, it is difficult to prevent production of such imperfect ice pieces, and fails to disclose a control algorithm for determining completion of ice making by applying other elements other than measurement of temperature.

Further, the ice maker according to the related art maintains a state in which ice pieces are constrained by the ice tray during an ice separating process despite an operation of the ice separating heater, disturbing rotation of the ice separating lever. That is, ice pieces are compulsorily manufactured through continuous ice making while the ice pieces are not completely separated, and thus, an operation of the ice maker may be completely stopped.

DISCLOSURE

Technical Problem

An aspect of the present invention is to automatically determining a water shortage situation of an icemaker and prevent unnecessary waste of energy.

Another aspect of the present invention is to complexly determine a minimum ice making time and an ice making temperature to prevent production of imperfect ice pieces.

Another aspect of the present invention is to solve constraint of ice pieces generated in an ice separating process through reheating.

Technical Solution

In accordance with one aspect of the present invention, there is provided a method of controlling an icemaker for a refrigerator, comprising the steps of: (I) supply water; (II) determining whether water has been supplied in a predetermined time; and (III) determining again whether supply of water has failed in a row by a flow amount sensor, wherein if it is determined in the step (II) that water has not been supplied, the step returns to the step (I), and if it is determined in the step (11) that water has been supplied, the step proceeds to the step (III), and wherein if it is determined in the step (III) that water supply has failed in a row, the mode of the icemaker is converted to a preserving mode, and if it is determined that water supply has not failed in a row, the step proceeds to the step (I).

In accordance with another aspect of the present invention, there is provided a method of controlling an icemaker for a refrigerator, the method comprising the steps of: (I) starting an ice making operation; (II) determining whether an ice making time exceeds a minimum ice making completion time; and (III) determining whether an ice making temperature is lower than an ice making completion temperature, wherein according to the determination of the step (II), if it is determined that the ice making time exceeds a minimum ice making completion time, the step proceeds to the step (III), and if it is determined that the ice making time does not exceed the minimum ice making completion time, the step proceeds to the step (I), and wherein according to the determination of the step (III), if it is determined that the ice making temperature is lower than the ice making completion temperature, the step proceeds to the step (IV) for performing heating and ice separation, and if it is determined that the ice making temperature is not lower than the ice making completion temperature, the step returns to the step (I).

In accordance with another aspect of the present invention, there is provided a method of controlling an icemaker of a refrigerator, the method comprising the steps of: (I)

performing reheating; (II) pausing the reheating for 1 minute; and (III) determining whether ice pieces are withdrawn to the outside of the refrigerator; and wherein according to the determination of the step (III), if it is determined that the ice pieces have been withdrawn to the outside of the refrigerator, the step proceeds to the step (V) of performing reheating to a high temperature, and if it is determined that the ice pieces have not been withdrawn to the outside of the refrigerator, the step proceeds to the step (IV) of determining whether ice separation has begun, and wherein according to the determination of the step (IV), if it is determined that the ice separation has begun, the step proceeds to the step (VI) of performing reheating to a low temperature, and if it is determined that the ice separation has not begun, the step proceeds to the step (V) of performing reheating to a high temperature.

Advantageous Effects

According to the present invention, a method of controlling an icemaker for a refrigerator can repeatedly determine water supply of an icemaker several times to automatically determine a water shortage situation of the ice maker, preventing unnecessary waste of energy.

Further, production of imperfect ice pieces can be prevented by providing a minimum ice making time for completion of ice making and complexly determining ice making temperature.

Further, even when an error (a breakdown, a malfunction, and an error in a measured value) of a sensor occurs, production of imperfect ice pieces can be restrained as a minimum ice making time is provided.

Furthermore, constraint of ice pieces generated during an ice separating process can be solved through repetitive reheating.

BEST MODE

Hereinafter, first to third exemplary embodiments of the present invention will be described in detail with reference to the accompanying drawings.

First Embodiment

Figure 1:
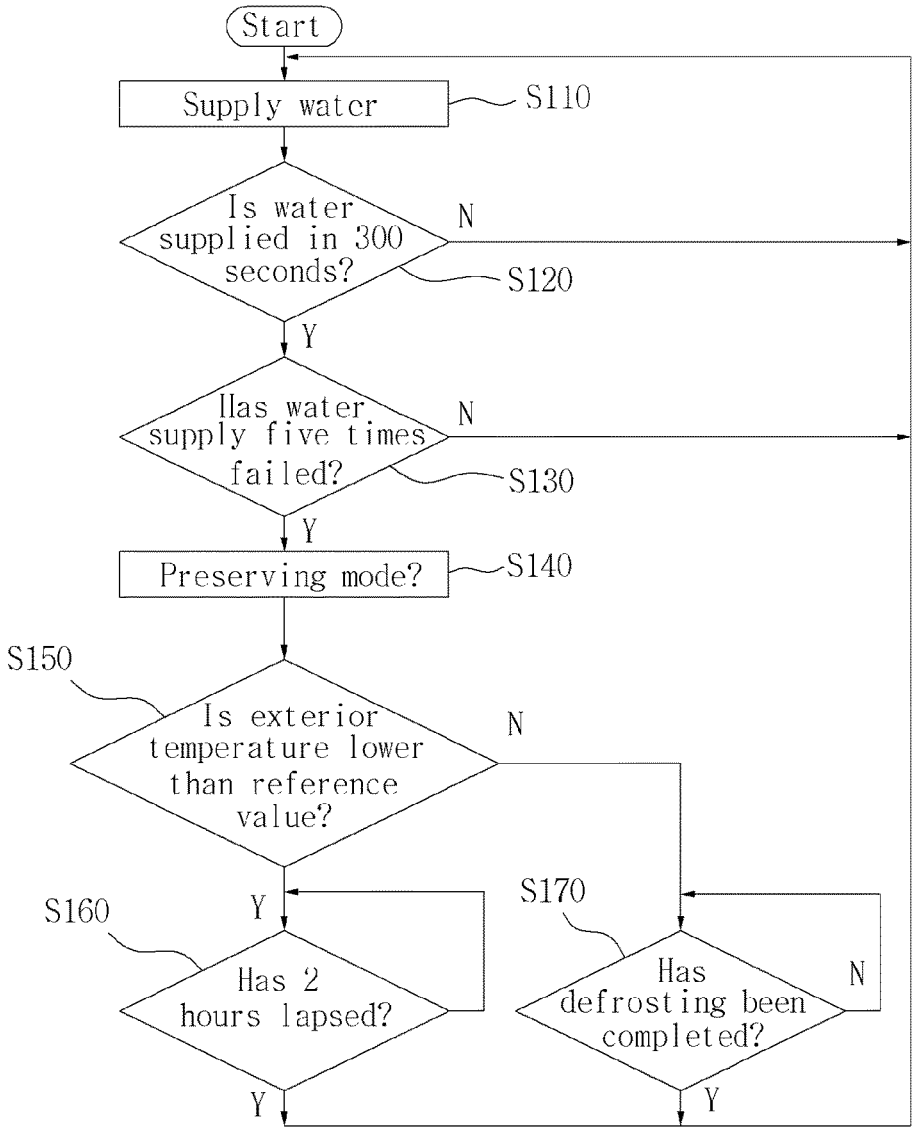
FIG. 1 is a flowchart schematically showing a method of controlling an icemaker for a refrigerator by which a water shortage situation can be automatically determined according to a first embodiment of the present invention.

FIG. 1 is a flowchart schematically showing a method of controlling an icemaker for a refrigerator by which a water shortage situation can be automatically determined according to a first embodiment of the present invention.

The method of controlling an icemaker for a refrigerator by which a water supply situation of the icemaker is determined will be described with reference to the accompanying drawing FIG. 1.

First, water is supplied to an ice tray of the icemaker (S110).

Next, it is determined whether water is supplied to the ice tray (S120).

Then, it is determined whether water has been supplied in 300 seconds, and if it is determined that water has not been supplied to the ice tray in 300 seconds, the step returns to step S110, and if it is determined that water has been supplied to the ice tray in 300 seconds, the step proceeds to the next step S130.

Here, 300 seconds means that the water supply time is limited, and if even an small amount of water has been supplied in 300 seconds, it is determined that water has been supplied, and whether an amount of water necessary for the actual water supply will be determined in the following step S130.

Further, it is determined by a flow amount sensor whether the supply of water to the ice tray has failed five times in a row (S130).

Then, if it is determined that the supply of water to the ice tray has failed five times in a row, the mode of the icemaker is converted into an preserving mode (S140), and if it is determined that the supply of water to the icemaker has not failed five times in a row, the step returns to step S110.

Accordingly, a water shortage situation of the icemaker is automatically determined by repeatedly determining supply of water to the ice tray of the icemaker a plurality of times, making it possible to prevent unnecessary waste of energy.

That is, the mode is prevented from unnecessarily entering an ice making mode while water is not supplied, making it possible to lower power consumption.

Next, after step S140, an exterior temperature of the refrigerator is determined by comparing it with a reference value (S150).

Then, if it is determined that the exterior temperature of the refrigerator is lower than a reference value, step S150 proceeds to step S160 for determining a lapse time in the preserving mode, and if it is determined that the exterior temperature of the refrigerator exceeds the reference value, the step proceeds to step S170 of determining whether the refrigerator has been defrosted.

That is, it is determined in step S150 whether the refrigerator starts to be defrosted, in which case since a defrosting operation of the refrigerator is generally automatically performed when an exterior (installation) temperature of the refrigerator is a predetermined temperature or higher and the icemaker separates ice pieces from the ice tray when the refrigerator is defrosted, a time point when the defrosting of the refrigerator ends is determined to be a time point when it is necessary to supply water to the ice tray again.

Since the temperature of the freezing compartment rises during the defrosting of the refrigerator and the temperature of the ice tray of the icemaker installed in the freezing compartment also rises when the ice separating heater heats the ice tray during separation of ice pieces, the defrosting of the refrigerator and the ice separation of the ice maker are simultaneously performed, considering freezing efficiency of the refrigerator.

If it is determined in step S160 that a reference time has elapsed in the preserving mode, the step returns to step S110 to determine again whether water is to be supplied to the ice tray, and if it is determined that the reference time has not elapsed in the preserving mode, step S160 is repeated.

Then, the reference time is preferably 2 hours.

Next, if it is determined in step S170 that the defrosting of the refrigerator has been completed, the step returns to step S110 to determine again whether water is to be supplied to the ice tray, and if it is determined that the defrosting of the refrigerator has not been completed, step S170 is repeated.

In this way, a water shortage situation can be automatically determined by repeatedly determining whether water is supplied to the icemaker a plurality of times, making it possible to prevent unnecessary waste of energy.

Second Embodiment

Figure 2:
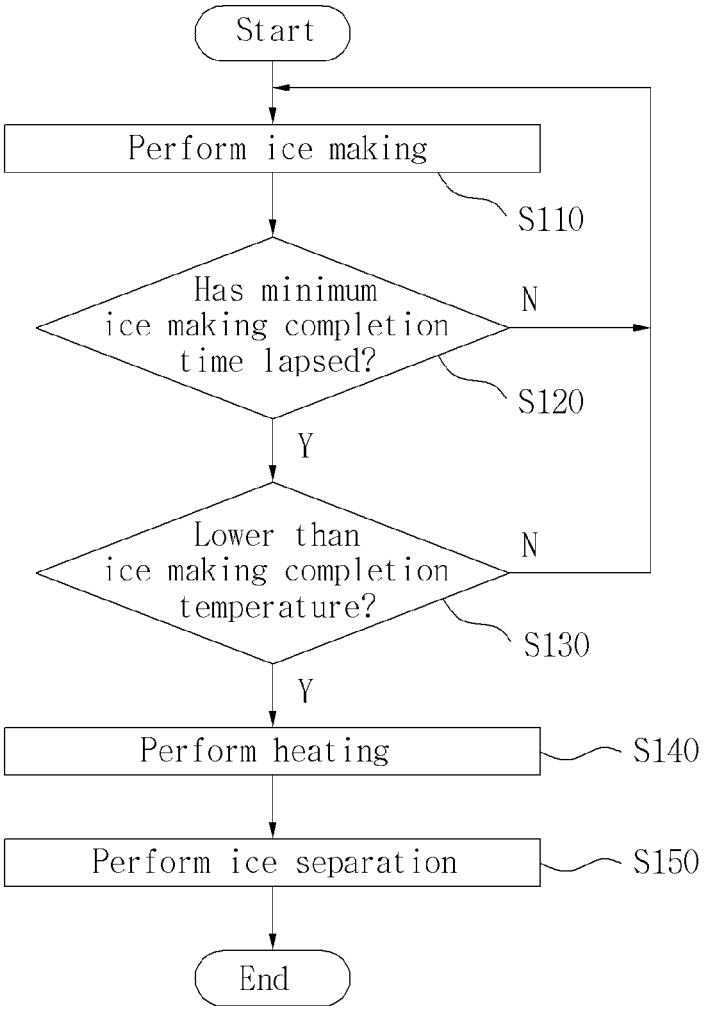
FIG. 2 is a flowchart schematically showing a method of controlling an icemaker for a refrigerator by which production of imperfect ice pieces can be prevented according to a second embodiment of the present invention.

FIG. 2 is a flowchart schematically showing a method of controlling an icemaker for a refrigerator by which production of imperfect ice pieces can be prevented according to a second embodiment of the present invention.

The method of controlling an icemaker for a refrigerator by which completion of ice making is determined will be described with reference to FIG. 2.

First, an ice making operation begins (S110).

Next, it is determined whether an ice making time exceeds a minimum ice making completion time (s120).

Then, if it is determined that the ice making time exceeds the minimum ice making completion time, the step proceeds to the next step S130, and if it is determined that the ice making time does not exceeds the minimum ice making completion time, the step proceeds to step S110.

According to an experimental result, a time for completing ice making is generally 50 minutes, and thus the minimum ice making completion time is preferably 45 minutes. The minimum ice making completion time is set to 45 minutes in order to determine completion of ice making in the following step S130 while production of imperfect ice pieces is maximally restrained.

Meanwhile, it is apparent that the minimum ice making completion time is not specifically limited to 45 minutes, but may be adjusted according to a refrigerator temperature (environment) of the freezing compartment.

Further, it is determined whether the ice making temperature of the ice tray is lower than the ice making completion temperature (S130).

Then, it is determined whether ice making is completed by comparing an ice making temperature of the ice tray with an ice making completion temperature (ice making off point), in which case if the ice making temperature of the ice tray is lower than the ice making completion temperature (ice making off point), it is determined that ice making is completed and the step proceeds to the next step S140, and if it is determined that the ice making temperature of the ice tray is not lower than the ice making completion temperature (ice making off point), the step proceeds to step S110.

Next, as the ice making is completed, heating of the ice tray is performed (S140).

Further, as the heating of the ice tray is completed, separation of ice pieces is performed (S150).

In this way, production of imperfect ice pieces can be prevented by providing the minimum ice making time and complexly determining the ice making temperature until completion of the ice making, and production of imperfect ice pieces can be restrained by providing the minimum ice making time even when an error (a breakdown, a malfunction, an error of measured value, and the like) of a sensor is generated.

Third Embodiment

Figure 3:
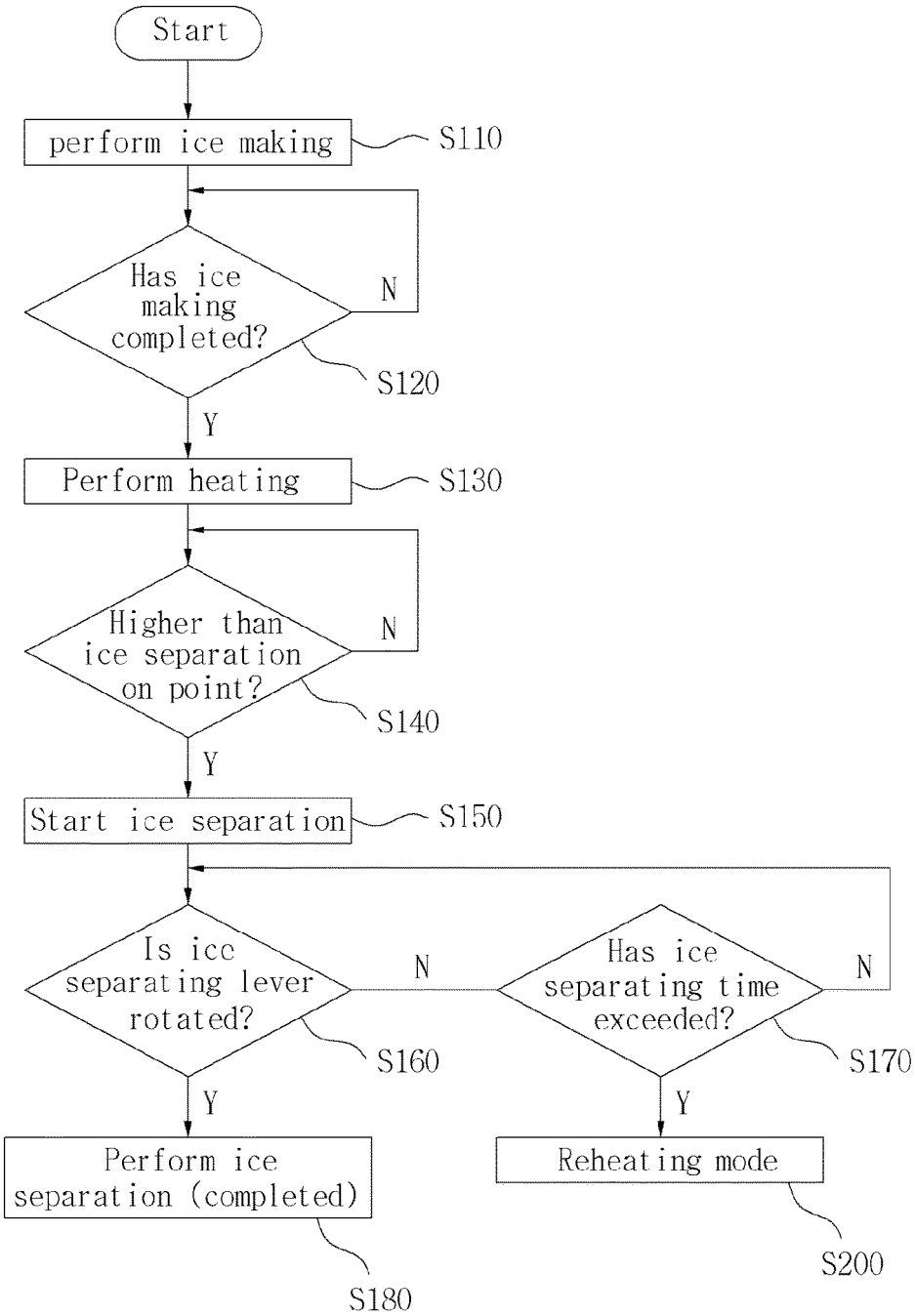
FIG. 3 is a flowchart schematically showing a method of controlling an icemaker for a refrigerator by which defective ice separation can be solved according to a third embodiment of the present invention.

FIG. 3 is a flowchart schematically showing a method of controlling an icemaker for a refrigerator by which defective ice separation can be solved according to a third embodiment of the present invention.

An ice making operation of the ice maker will be briefly described with reference to FIG. 3.

First, an ice making operation is performed (S110).

Next, it is determined whether ice making is completed (S120).

Then, it is determined whether the ice making is completed by comparing the temperature of the ice tray with an ice making off point (temperature), in which case if it is determined that the temperature of the ice tray is lower than an ice making off point, the step proceeds to step S130, and if it is determined that the temperature of the ice tray is not lower than the ice making off point, step S120 is repeated.

As the ice making is completed, heating of the ice tray is performed (S130).

Next, it is determined whether the temperature of the ice tray is an ice separation starting temperature (S140).

Then, it is determined whether the separation of ice pieces may begin by comparing the temperature of the ice tray with the ice separating on point (temperature), in which case if it is determined that the temperature of the ice tray is a ice separating on point or higher, the step proceeds to step S150, and if it is determined that the temperature of the ice tray is lower than the ice separating on point, the step proceeds to step S140.

Further, the ice separating lever starts to be rotated (S150).

Next, it is determined whether the ice separating lever starts to be rotated (S160).

Then, if it is determined that the rotation of the ice separating lever begins, the step proceeds to step S180 for performing the separation of ice pieces, and if it is determined that the rotation of the ice separating lever has not begun, the step proceeds to the next step S170.

Further, it is determined whether the ice separating lever has been rotated for a predetermined time (S170).

Then, if it is determined that the ice separating lever has been rotated for a predetermined time, the step proceeds to step S160, and if it is determined that the ice separating lever has not been rotated for a predetermined time, the step proceeds to step S200 corresponding to a reheating mode of the ice tray.

That is, the entry into step S200 corresponds to a state in which ice pieces are constrained by the ice tray and rotation of the ice separating lever is limited.

Of course, the predetermined time should be divided by a predetermined time interval ($\Delta t$) for the determination.

Figure 4:
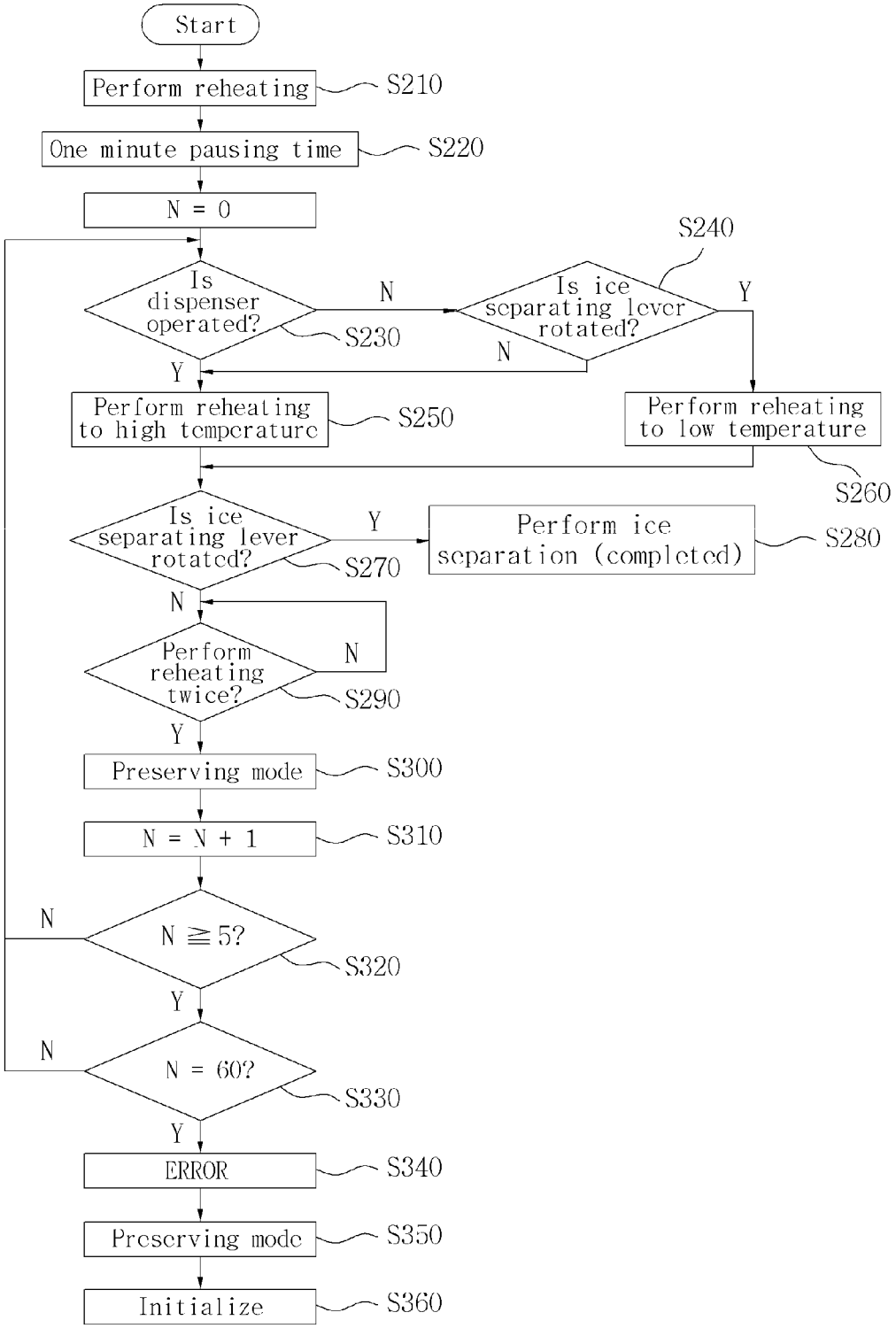
FIG. 4 is a flowchart schematically showing a reheating mode of the icemaker for a refrigerator according to the third embodiment of the present invention.

FIG. 4 is a flowchart schematically showing a reheating mode of the icemaker for a refrigerator according to the third embodiment of the present invention.

The reheating mode of the ice maker will be described with reference to FIG. 4.

First, the ice tray is reheated (S210).

Next, the reheating of the ice tray is paused for one minute (S220).

Then, the heating temperature is increased to provide a time for removing ice pieces constrained by the ice tray.

Further, it is determined whether ice pieces are withdrawn into the dispenser of the refrigerator (S230).

Then, if it is determined that the ice pieces have not been withdrawn into the dispenser, the step proceeds to step S240, and if it is determined that the ice pieces are withdrawn into the dispenser, the step proceeds to step S250 for reheating the ice tray to a high temperature.

Next, it is determined whether rotation of the ice separating lever has begun (S240).

Then, if it is determined that rotation of the ice separating lever has begun, the step proceeds to step S260 of reheating the ice tray to a low temperature, and if it is determined that rotation of the ice separating lever has not been begun, the step S250 of reheating the ice tray to a high temperature.

That is, since the ice pieces constrained by the ice tray are partially melted so that separation of ice pieces can be performed when the ice separating lever is rotated, reheating of the ice tray is performed at a low temperature, and when the ice separating lever is not rotated, the ice pieces remains constrained by the ice tray and the reheating of the ice tray to a high temperature is performed.

Meanwhile, in step S250, the high-temperature reheating temperature is approximately 5 to 15° C. and the low-temperature reheating temperature is approximately −2 to 2° C.

Further, as after steps S250 and S260, it is determined again whether rotation of the ice separating lever has begun (S270).

Then, if it is determined that rotation of the ice separating lever has begun, the step proceeds to step S280 for rotating the ice separating lever until the ice pieces of the ice tray are separated, and if it is determined that rotation of the ice separating lever has not begun, the step proceeds to step S290.

Meanwhile, after step S280, an ice making cycle of sequentially performing water supply and ice making begins again.

Next, reheating of the ice tray is performed twice (S290).

Further, the mode of the ice maker is converted into a preserving mode, which is maintained for 240 minutes (S300).

Here, it is noted that the preserving mode is not an ice making operation of the ice maker but a mode of preserving completely made ice pieces in the ice bank.

Then, if ice pieces are withdrawn in step S300, the reheating mode begins.

That is, if the ice pieces are withdrawn, the ice pieces completely made in the ice tray start to be separated.

Next, steps S230 to S300 are repeated 5 to 60 times (S310 to S330).

Then, the number of repetitions of 5 times generally corresponds to a one day period, and the number of repetitions of 60 times generally corresponds to a one month period.

Meanwhile, the number of repetitions is not limited to 5 to 60 times and can be changed as necessary.

After step S330, an icemaker error message is output (S340), and the mode of the icemaker is converted into the preserving mode (S350).

Next, after step S350, an error is initialized after 6 hours (S360).

After step S360, it is preferable to repeat steps S210 to S350.

In this way, the constraint of the ice pieces generating in the ice separating process is solved through the repeated reheating. That is, a defective ice separating operation is solved by the reheating so that a normal ice making cycle can be carried out.

The invention has been described in detail with reference to preferred embodiments thereof. However, it will be appreciated by those skilled in the art that changes may be made in these embodiments without departing from the principles and spirit of the invention, the scope of which is defined in the appended claims and their equivalents.

The invention claimed is:

1. A method of controlling an icemaker for a refrigerator, comprising the steps of:

(I) issuing a control signal to supply water to the icemaker;

(II) determining whether or not water has been supplied during a predetermined time after the step (I)

wherein if it is determined that water has not been supplied, the step returns to the step (I); and (III) determining whether or not supply of water has failed predetermined times consecutively, wherein if it is determined that water supply has failed predetermined times consecutively, the mode of the icemaker is converted to a preserving mode, and if it is determined that water supply has not failed predetermined times consecutively, the step proceeds to the step (I).

2. The method of claim 1, further comprising the step of: after the step (III), (IV) comparing an exterior temperature of the refrigerator with a reference value to determine whether or not it is lower than the reference value.

3. The method of claim 2, wherein if it is determined that the exterior temperature of the refrigerator is lower than a reference value, the step (IV) proceeds to the step (V) of determining a lapse time in the preserving mode, and if the exterior air of the refrigerator exceeds the reference value, the step (IV) proceeds to the step (VI) of determining whether defrosting of the refrigerator is completed.

4. The method of claim 3, wherein the step (V) returns to the step (I) if the lapse time in the preserving time exceeds a reference time, and is repeated if the lapse time in the preserving time does not exceed the reference time.

5. The method of claim 3, wherein the step (VI) returns to the step (I) if it is determined that the defrosting of the refrigerator is completed, and is repeated if it is determined that the defrosting of the refrigerator is not completed.

6. A method of controlling an icemaker of a refrigerator, the method comprising the steps of:

(I) performing reheating after an initial heating operation has been performed;

(II) pausing the reheating for 1 minute; and (III) determining whether ice pieces are withdrawn to the outside of the refrigerator; and wherein according to the determination of the step (III), if it is determined that the ice pieces have been withdrawn to the outside of the refrigerator, the step proceeds to the step (V) of performing reheating to a high temperature, and if it is determined that the ice pieces have not been withdrawn to the outside of the refrigerator, the step proceeds to the step (IV) of determining whether ice separation has begun, and wherein according to the determination of the step (IV), if it is determined that the ice separation has begun, the step proceeds to the step (VI) of performing reheating to a low temperature, and if it is determined that the ice separation has not begun, the step proceeds to the step (V) of performing reheating to a high temperature.

7. The method of claim 6, further comprising the step (VII) of:

after the steps (V) and (VI), determining again whether ice separation has begun, wherein according to the determination of the step (VII), if it is determined that the ice separation has begun, the ice separation begins, and if it is determined that the ice separation has not begun, the step proceeds to the step (VIII) of performing reheating twice.

8. The method of claim 7, further comprising the step (IX) of: after the step (VIII), converting the mode of the icemaker into a preserving mode and maintaining the preserving mode for a predetermined time.

9. The method of claim 8, further comprising the step (X) of: repeating the steps (III) to (IX) 5 to 60 times.

10. The method of claim 9, further comprising the step (XI) of:

after the step (X), outputting an icemaker error message and converting the mode of the icemaker into the preserving mode.

11. The method of claim 6, wherein in the step (II), the heating temperature rises.

* * * * *